US007712750B2

(12) United States Patent
Whiteside et al.

(10) Patent No.: US 7,712,750 B2
(45) Date of Patent: May 11, 2010

(54) UPHOLSTERED CREEPER

(75) Inventors: Kirt E. Whiteside, Marion, OH (US); Shane Obitts, Elyria, OH (US); Kristin C. Mays, Delaware, OH (US)

(73) Assignee: Whiteside Mfg. Co., Delaware, OH (US)

( * ) Notice: Subject to any disclaimer, the term of this patent is extended or adjusted under 35 U.S.C. 154(b) by 163 days.

(21) Appl. No.: 11/811,618

(22) Filed: Jun. 12, 2007

(65) Prior Publication Data

US 2008/0309035 A1 Dec. 18, 2008

(51) Int. Cl.
*B25H 5/00* (2006.01)

(52) U.S. Cl. ..... 280/32.6; 280/32.5; 280/79.3; 280/79.2; 280/79.11; 280/47.34

(58) Field of Classification Search ..... 280/32.6, 280/32.5, 79.3, 79.2, 79.11, 47.34
See application file for complete search history.

(56) References Cited

U.S. PATENT DOCUMENTS

D354,599 S * 1/1995 Young ..... D34/23
5,524,915 A * 6/1996 Liu ..... 280/30
5,860,174 A * 1/1999 Failor ..... 5/81.1 HS
6,578,857 B1 * 6/2003 Whiteside et al. ..... 280/32.6
6,742,792 B1 * 6/2004 Hooper et al. ..... 280/79.3
6,902,174 B2 * 6/2005 Hernandez et al. ..... 280/32.6
7,032,908 B2 * 4/2006 Melvin ..... 280/32.6
7,070,189 B2 * 7/2006 Grauss ..... 280/32.6
7,293,783 B2 * 11/2007 Whiteside et al. ..... 280/32.6
7,434,817 B2 * 10/2008 Rush ..... 280/32.5
7,478,818 B1 * 1/2009 Whiteside et al. ..... 280/32.6
7,481,438 B2 * 1/2009 Hernandez ..... 280/32.6
2001/0020773 A1 * 9/2001 Whiteside ..... 280/32.6
2005/0275173 A1 * 12/2005 Hernandez et al. ..... 280/32.6

* cited by examiner

*Primary Examiner*—Lesley Morris
*Assistant Examiner*—Marlon A Arce
(74) *Attorney, Agent, or Firm*—Renner, Kenner, Greive, Bobak, Taylor & Weber

(57) ABSTRACT

A creeper includes an inner framework having longitudinally extending, laterally spaced side rails interconnected by one or more cross members extending therebetween. A support plate is secured to the inner framework. A pad is positioned on the support plate and a cover encompasses the pad and at least a portion of the inner framework therein. A plurality of caster assemblies are secured to the inner framework.

17 Claims, 8 Drawing Sheets

UPHOLSTERED CREEPER

TECHNICAL FIELD

This invention relates to a mechanic's creeper. More particularly, this invention relates to an upholstered creeper having an internal frame encased in an exterior cover.

BACKGROUND ART

Typical mechanic's creepers include a frame having parallel, longitudinally extending side rails that carry casters which render the creeper mobile. The side rails are interconnected at their ends and also usually connected by a plurality of laterally extending, longitudinally spaced crossmembers to form a support frame. A pad is secured to the top of the frame to support the body of the user of the creeper. The pad is usually provided with a thickened area which serves as a headrest.

This exterior framework type design does have its drawbacks. First, they are not particularly comfortable for a user. Users have come to expect greater comfort in creepers, and without an altogether new approach, the exterior framework creeper's capability for increased comfort is limited.

Besides comfort, prior art creepers are also susceptible to damage, particularly at the area of contact between the exterior frame and the pad. This is because the pad is typically secured to the exterior frame by mechanical fasteners, which are susceptible to tearing and displacement.

Thus, the need exists for a creeper which eliminates the problems discussed above, which is more comfortable, aesthetically pleasing and supportive.

DISCLOSURE OF THE INVENTION

In accordance with one aspect of the present invention it is an object to provide a creeper which includes an internal support framework.

In accordance with another aspect of the present invention, it is an object to provide a creeper having an exterior cover encapsulating the entire creeper.

These and other objects of the present invention, as well as the advantages thereof over existing prior art forms, which will become apparent from the description to follow, are accomplished by the improvements hereinafter described and claimed.

In general, a creeper made in accordance with the present invention includes an inner frame having laterally spaced side rails interconnected by one or more cross members extending therebetween. A spanning member is secured to the inner frame. A pad is positioned on the support plate. A cover encompasses the pad and at least a portion of the inner frame therein and a plurality of caster assemblies are secured to the inner frame.

Another creeper made in accordance with the present invention includes an internal support structure that defines a headrest portion and a body portion adapted to support the weight of a user. A cover encompasses at least a portion of the internal support structure, and a plurality of caster assemblies are secured to the internal support structure.

A preferred exemplary creeper according to the concepts of the present invention is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
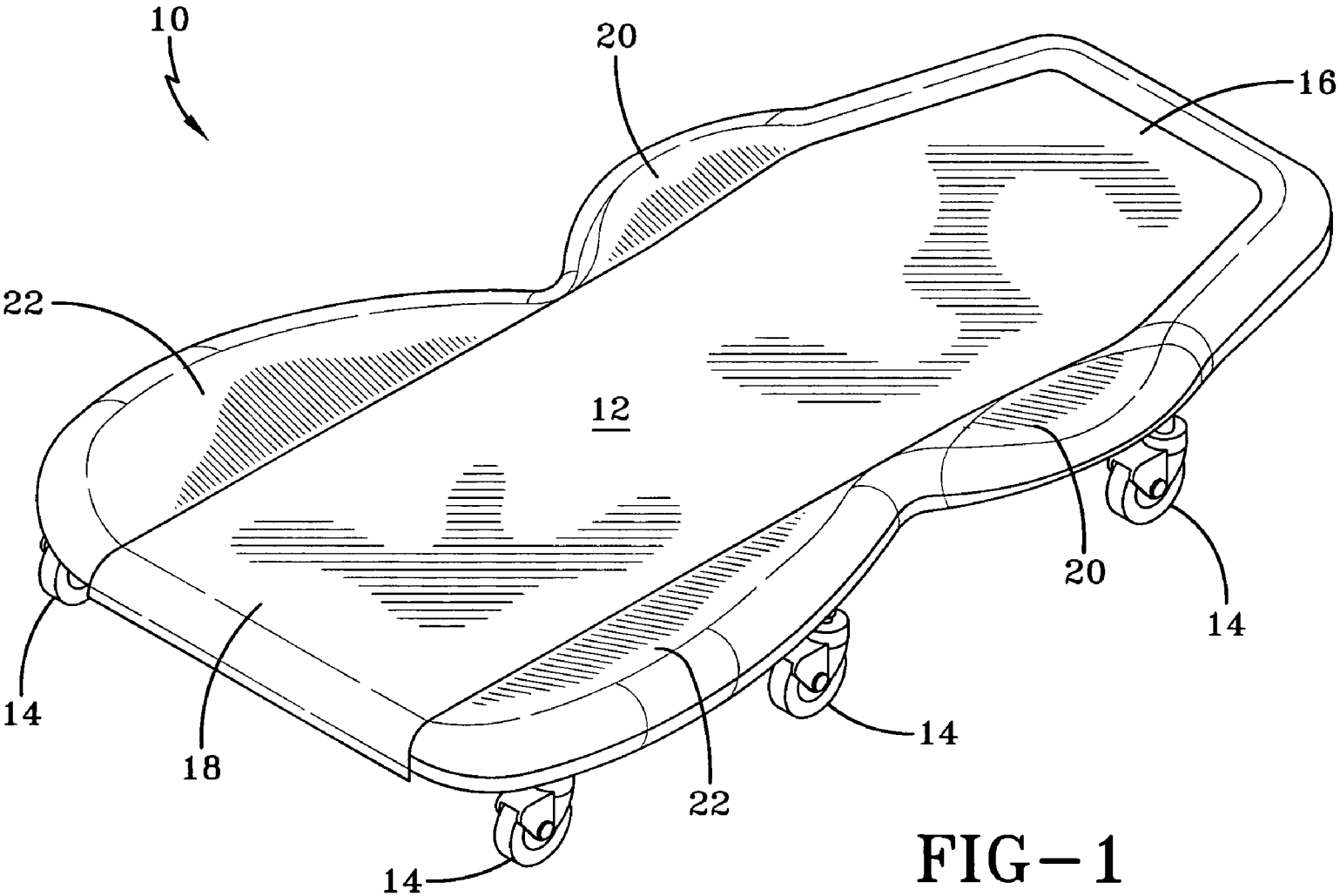
FIG. 1 is a perspective view showing a creeper made in accordance with the concepts of the present invention.

A mechanic's creeper made in accordance with the concepts of the present invention is generally indicated by the numeral 10. Creeper 10 generally includes a body portion 12 that carries a plurality of casters 14. Body 12 is shaped to comfortably receive a user lying on his or her back, and casters 14 allow the user to roll along the ground to enable access to the undercarriage of a vehicle.

Body 12 includes a top end 16 where a user places their head and a bottom end 18 where a users feet are positioned. A first pair of opposed shoulders 20 extend outwardly and upwardly from the longitudinal edge of body 12. Shoulders 20 are adapted to provide added support to the upper torso of the user. Because shoulders 20 are raised, they act to keep the user securely positioned in the central portion of body 12.

Figure 2:
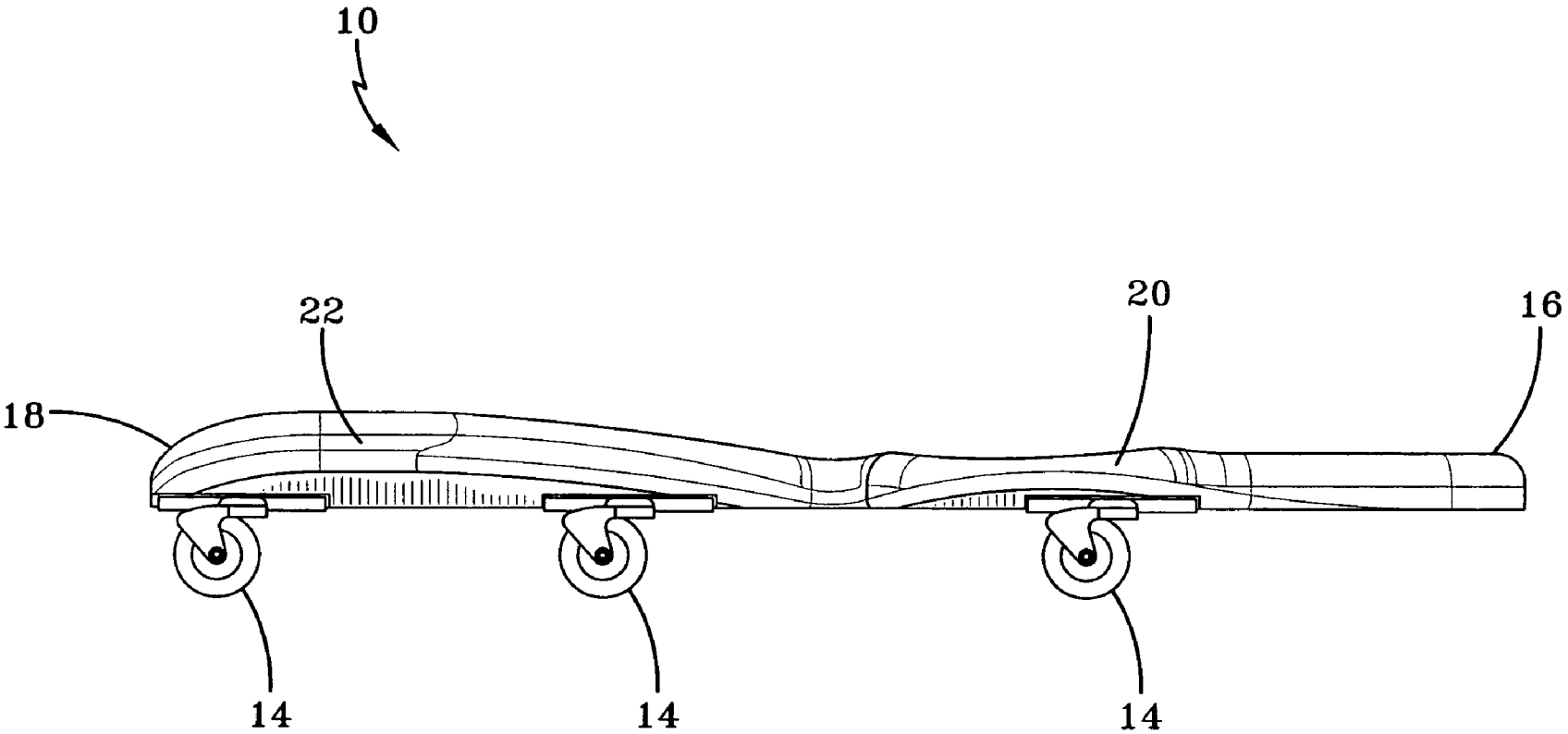
FIG. 2 is a side elevational view of the creeper shown in FIG. 1.

A second pair of opposed shoulders 22 extend outwardly and upwardly from the longitudinal edge of body 12. As is evident from FIGS. 1 and 2, shoulders 22 are positioned proximate to bottom end 18 of body 12. Like shoulders 20, shoulders 22 are adapted to provide support for the legs and lower torso of the user. Because shoulders 22 are raised, they act to keep the user securely positioned in the central portion of body 12.

Figure 3:
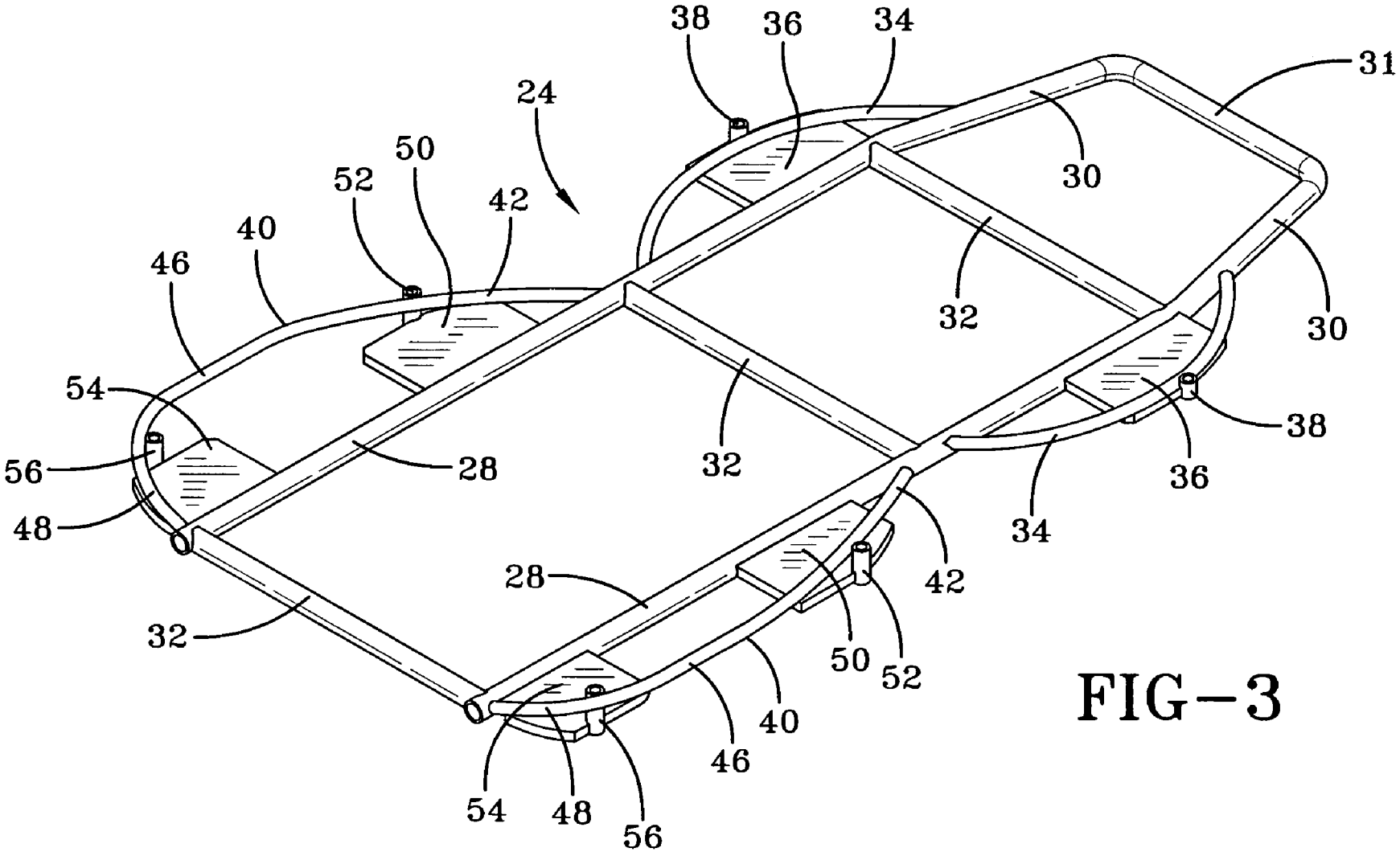
FIG. 3 is a perspective view of the internal frame of the creeper of FIG. 1.
Figure 5:
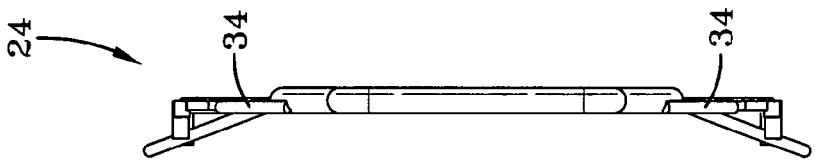
FIG. 5 is a front elevational view of the internal frame of the creeper of FIG. 1.
Figure 4:
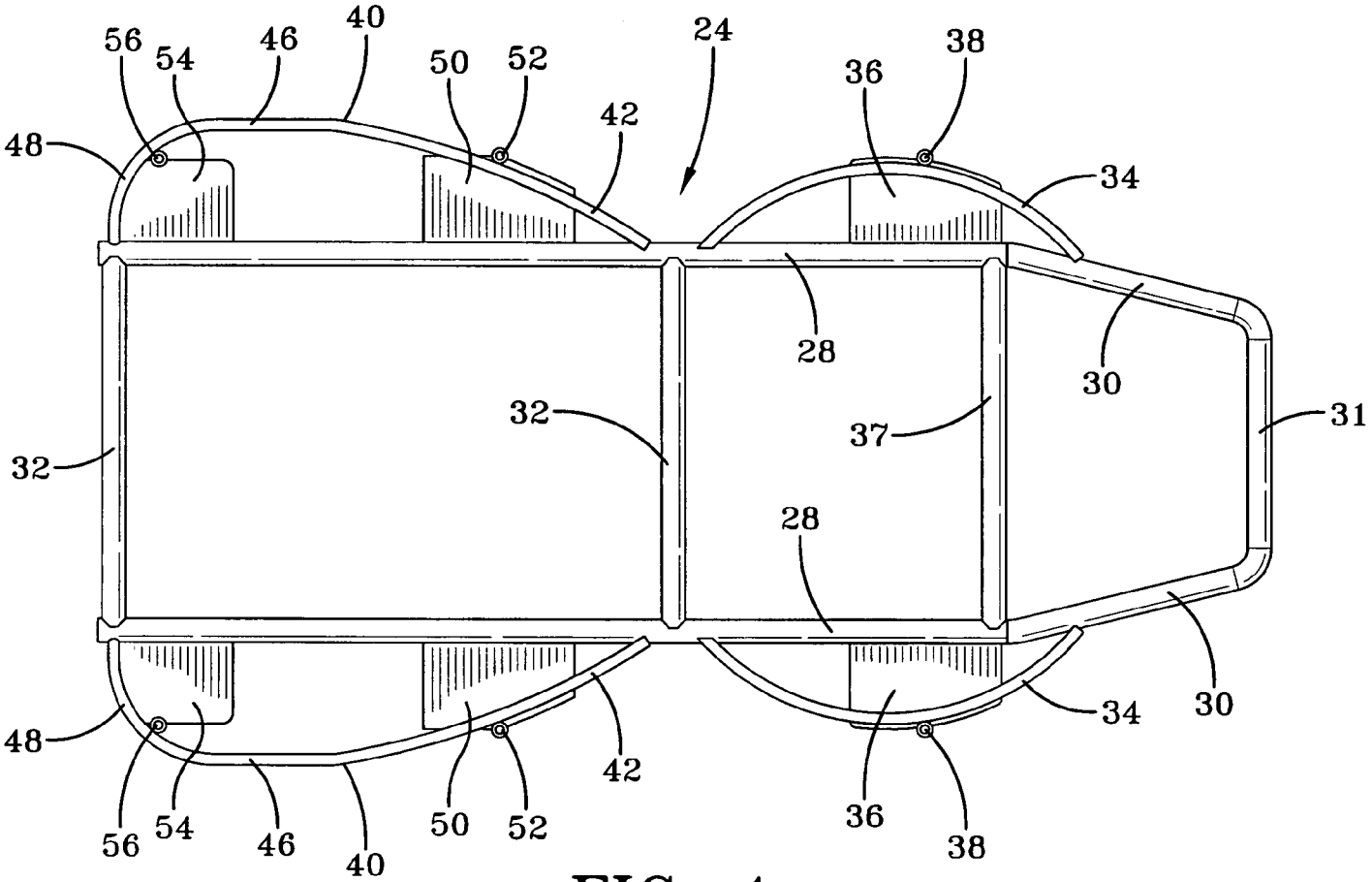
FIG. 4 is a top plan view of the internal frame of the creeper of FIG. 1.

Referring now to FIGS. 3-5, body 12 is formed with an inner framework, generally indicated by the numeral 24. In one or more embodiments, the components of inner framework 24 may be circular or tubular metal pieces. In these or other embodiments, the components of inner framework 24 may be formed with stamped metal elements. In still other embodiments, the components of inner framework may be formed of polymeric materials. Inner framework 24 may include a pair of generally straight, opposed side rails 28. Side rails 28 may be contiguous or may include a plurality of joined sections. Side rails 28 terminate at inwardly angled portions 30, which in turn both terminate at, and are joined by, a laterally extending head portion 31. It should be appreciated, however, that side rails 28 may extend all the way to laterally extending head portion 31 thereby eliminating angled portions 30. A plurality of spaced cross-members 32 may be provided that are laterally oriented and connect and extend between opposing side rails 28. In this manner inner frame 24 is rigid and adapted to carry the weight of a user.

Shoulders 20 are internally supported by support members 34. In the present embodiment, support members 34 are coupled at one end to side rails 28 at a position generally centrally of side rails 28. The other end of support members 34 are coupled to a location on angled portions 30. Support members 34 may be coupled to side rails 28 by any means, for example, welding, adhesives or mechanical fasteners.

Support plates 36 are secured to side rail 28 between the two ends of support members 34. Support plates 36 may include an outer profile sized to match the outer profile of support members 34. Each support plate carries a bushing 38 on the outside edge thereof. Each bushing 38 is adapted to rotatably receive and support a caster 14. Bushings 38 extend upwardly from support plate 36 and may further be coupled to support member 34. In this manner, support plate 36 and support member 34 provide the internal support for shoulders 20 while also providing a mounting area for bushing 38 that receives a caster 14 therein. It should be appreciated that any caster type may be employed in the present invention. In one ore more embodiments, casters 14 may include a threaded stem. In other embodiments, casters 14 may include non-threaded stems. In one or more embodiments, caster 14 may include a threaded stem and a plate, wherein the plate is secured to inner frame 24 via bolts. It should further be appreciated that, though in the present embodiment, support members 34 reside in generally the same plane as side rails 28, support members 34 may be angularly offset so that they extend upwardly from the plane of side rails 28.

Though the present embodiment discloses casters 14 being directly received in bushings 38 mounted to the inner framework 24, it should be appreciated that other mounting techniques may be employed. For example, casters 14 may be secured to body 12 using an outrigger type arrangement. In other words, rigid extending arms may extend outwardly from body 12 and carry casters 14 on the ends thereof.

Shoulders 22 are internally supported by support members 40. In the present embodiment, second members 40 are coupled at one end to a generally central portion of side rail 28. The other end of support members 40 are coupled to side rail 28 proximate to the bottom end thereof. As is evident from FIG. 5, support members 40 are angularly offset from side rail 28. In other words, support members 40 extend angularly upwardly and outwardly from side rails 28. Whereas support members 34 include a generally continuous curve, support members 40 may include distinct portions. Each support member 40 includes a gradually curving portion 42 extending rearwardly and upwardly from a generally central area of side rail 28. Gradually curving portion 42 terminates at a generally straight portion 46 that runs generally parallel to side rails 28. Finally, straight portion 46 terminates at a half-circle shaped portion 50 that extends to and terminates at a position proximate the bottom end of side rail 28. Support members 40 may be coupled to side rails 28 by any means, for example, welding, adhesives or mechanical fasteners.

Support plates 50 are secured to, and extend outwardly from, continuous frame 26, at a position proximate to gradually curved portion 42. Support plates 50 may include an outer profile sized to mirror the outer profile of gradually curving portion 42. Support plates 50 carry a bushing 52 on the outside edge thereof. Bushings 52 are adapted to rotatably receive and support a caster 14. Bushings 52 extend upwardly from each support plate 50 and may further be coupled to support member 40, as at gradually curving portion 42.

Additional support plates 54 are secured to, and extend outwardly from, side rail 28, at a position proximate to half-circle shaped portion 48. Support plates 54 may include an outer profile sized to mirror the outer profile of half-circle shaped portion 48. Each support plate 54 carries a bushing 56 on the outside edge thereof. Bushings 56 are adapted to rotatably receive and support a caster 14. Bushings 56 extend upwardly from support plate 54 and may further be coupled to support member 40, as at half-circle shaped portion 48. In this manner, support plates 50 and 54 and support member 40 provide the internal support for shoulders 22 while also providing a mounting area for the bushings 52 and 56 that receive a caster 14 therein.

Figure 6:
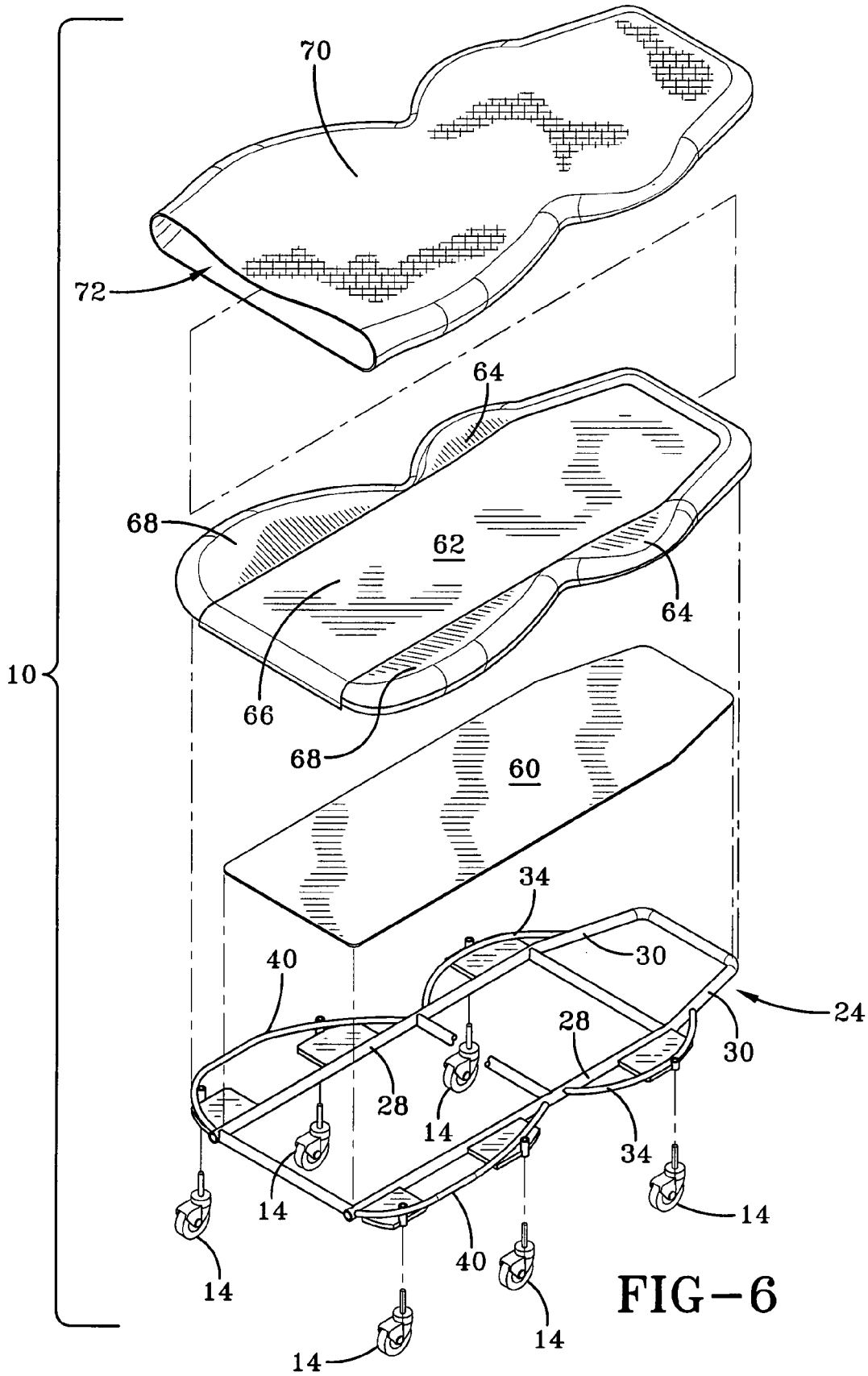
FIG. 6 is an exploded view of the creeper shown in FIG. 1.

Referring now to FIG. 6, a spanning member 60 may be secured to the top of inner frame 24. In the present embodiment, spanning member 60 includes an outer profile that generally matches that of side rails 28, however, it should be appreciated that spanning member 60 could also extend outwardly to the edges of support members 34 and 40. In one embodiment, spanning member 60 may be made of a thin metallic material such as aluminum or stainless steel. In other embodiments, spanning member 60 may include metal webbing, heavy canvas, plastic materials, cloth or fabric materials. In one or more embodiments, spanning member 60 may be pulled taut and secured to side rails 28. In any event, spanning member 60 is securedly attached to interior frame 24 and supports and distributes the weight of a user.

A pad 62 is positioned on top of, and is supported by spanning member 60. In one or more embodiments, pad 62 may be generally rectangular. In other embodiments, pad 62 may be shaped and include an outer profile generally matching the outer profile of interior framework 24, including a pair of opposed pad wings 64 that extend outwardly from the generally square central body 66 of pad 62. As discussed above, shoulder 20 may be raised relative to the central portion of body 12. This raised shoulder may be achieved by thickening the pad 62 in the area of first pad wing 64. The raised shoulder may also be achieved by having a uniform pad thickness and instead angling support members 34 upwardly.

Pad 62 also includes another pair of opposed pad wings 68 that extend outwardly from central body 66 of pad 62. As discussed above, shoulder 22 may be raised relative to the central portion of body 12. This raised shoulder may be achieved by thickening the pad 62 in the area of pad wing 68. The raised shoulder may also be achieved by having a uniform pad thickness and instead angling support members 40 upwardly.

Once spanning member 60 and pad 62 have been secured to inner framework 24, a cover 70 may be provided to encapsulate the assembly. Cover 70 may be any durable material and can include canvas, leather, synthetic leather, car seat upholstery, or any other material suitable for a creeper environment. Cover 70 may be of a one-piece design, having an opening 72 at one end, so that when interior frame 24, spanning member 60 and pad 62 are assembled, they are inserted through the open end 72 of cover 70. In other embodiments, cover 70 may be of a two piece design, such that when interior frame 24, spanning member 60 and pad 62 are assembled, one cover half is inserted over either end and then overlap a predetermined amount. In still other embodiments cover 70 may be of a three piece design. In still other embodiments, cover 70 may cover pad 62 and wrap around the edges of interior frame 24 in a manner such that a portion of the bottom of creeper 10 is not covered by cover 70. In these or other embodiments, cover 70 may be composed of a resilient material such that cover 70 may be stretched, positioned on interior frame 24 and then allowed to contract onto pad 60.

Figure 7:
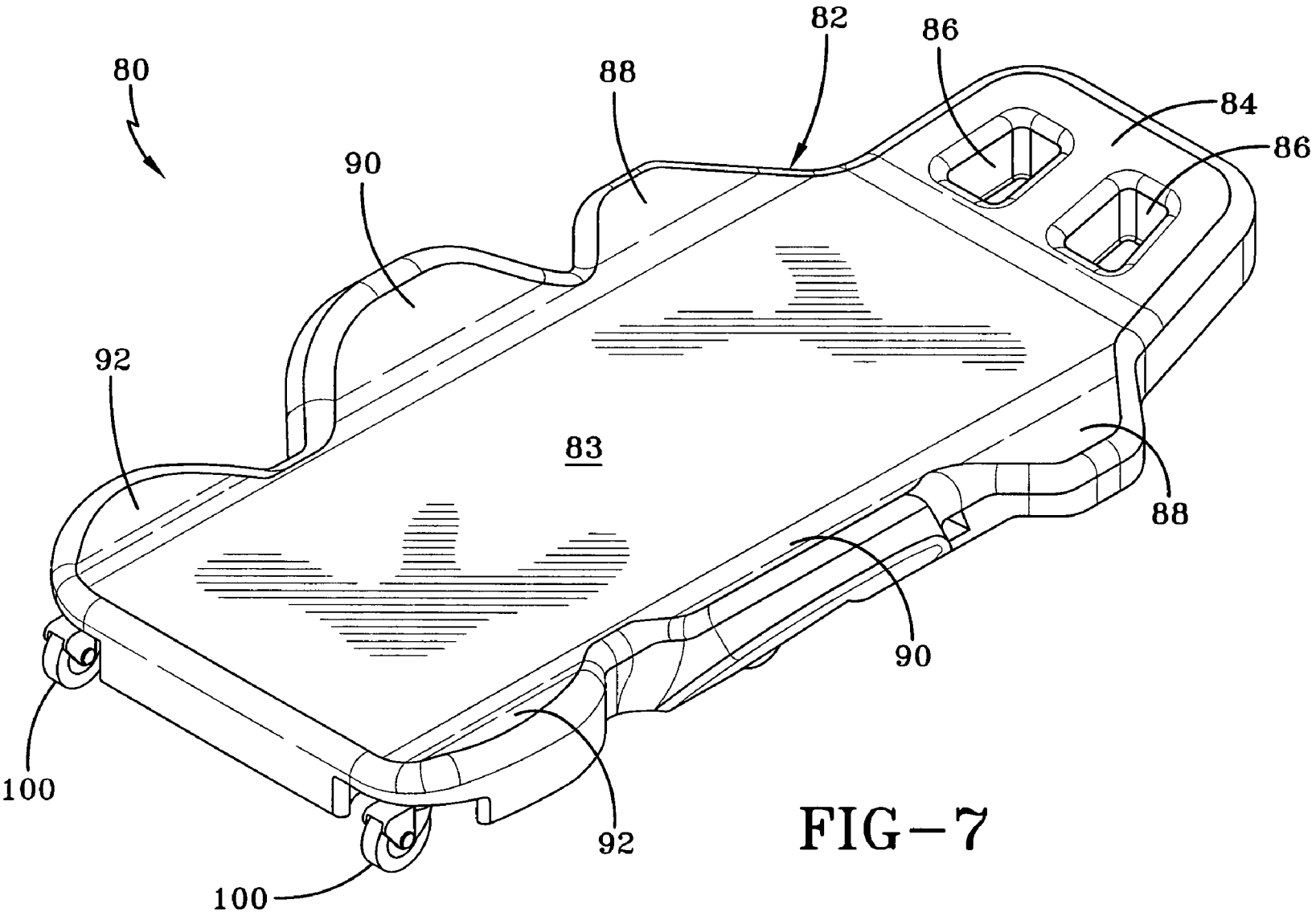
FIG. 7 is a perspective view of an alternate creeper made in accordance with the concepts of the present invention.

Referring now to FIG. 7, an alternate creeper is disclosed and generally indicated by the numeral 80. Creeper 80 includes an internal support structure generally indicated by the numeral 82. Support structure 82 includes a main body portion 83, and a head rest 84 extends outwardly and upwardly from body 83. Though an angled head rest is shown, it should be appreciated that head rest 84 may also be coplanar with body 83. Head rest 84 may also include one or more through holes 86 that may provide additional ventilation, reduce overall weight, and provide a gripping area to grip and carry creeper 80.

A pair of opposed shoulders 88 extend outwardly and upwardly from the longitudinal edge of body 83, proximate to head rest 84. Shoulders 88 are adapted to provide added support to the upper torso of the user. Because shoulders 88 are raised, they act to keep the user securely positioned in the central portion of body 83. In other embodiments, shoulders 88 may be generally co-planar with body 83. Whether shoulder 88 is raised or not, it also provides a wider support area so that a user may shift around to achieve better access to components under a vehicle.

Figure 8:
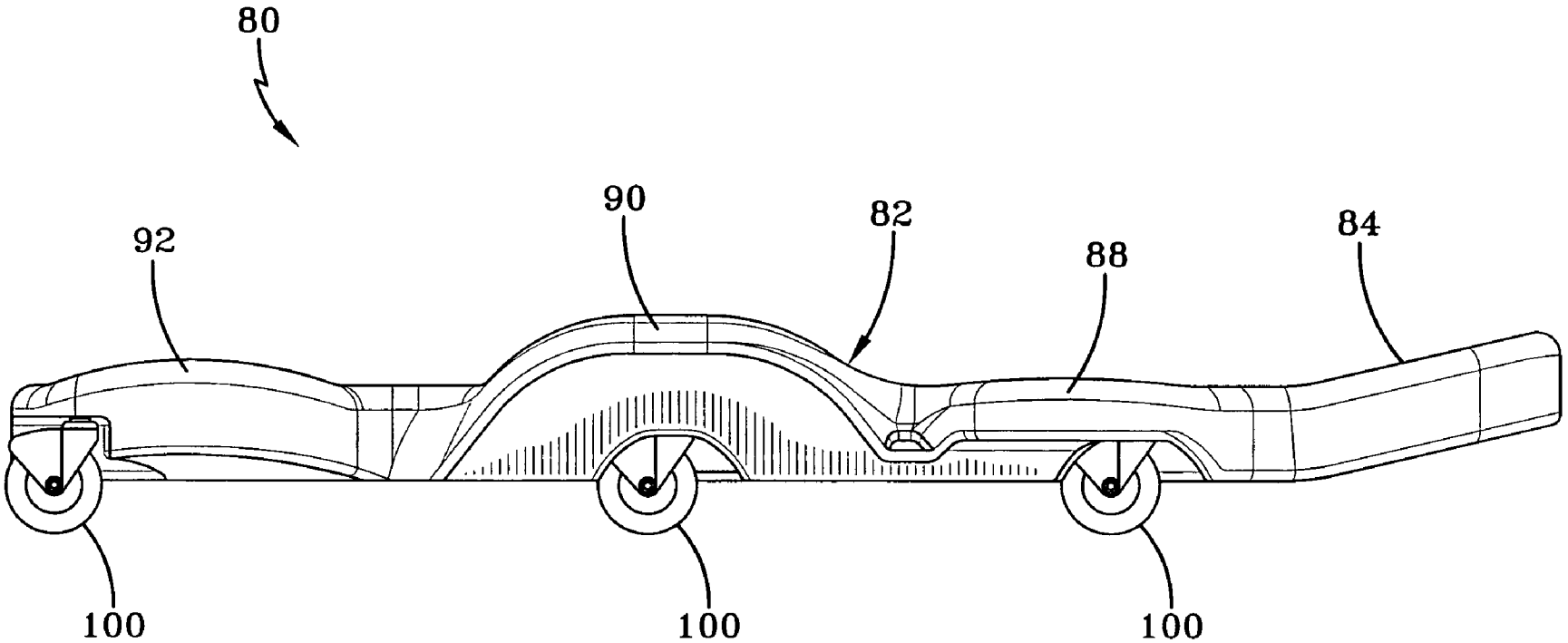
FIG. 8 is a side elevational view of the creeper of FIG. 7.

Another pair of opposed shoulders 90 extend outwardly and upwardly from the longitudinal edge of body 83. As is evident from FIGS. 7 and 8, shoulders 90 are positioned generally centrally of body 83. Like shoulders 88, shoulders 90 are adapted to provide support for the legs and lower torso of the user. Because shoulders 90 are raised, they act to keep the user securely positioned in the central portion of body 83.

An additional pair of opposed shoulders 92 extend outwardly and upwardly from the longitudinal edge of body 83. Shoulders 92 are positioned proximate to the bottom end of body 83, opposite head rest 84. Because shoulders 92 are raised, they act to keep the user securely positioned in the central portion of body 83. In other embodiments, shoulders 92 may be generally co-planar with body 83. In any event, shoulders 92 also provide a wider support area so that a user may shift around to achieve better access to components under a vehicle.

Support structure 82 may be composed of a polymeric material. In one or more embodiments, support structure 82 may be blow molded, injection molded, thermoformed, or the like. Support structure 82 is preferably a single integral member, but may also include two or more members fastened together. Support structure 82 may optionally include one or more internal support pieces, such as an internal frame (not shown), for added strength.

Figure 9:
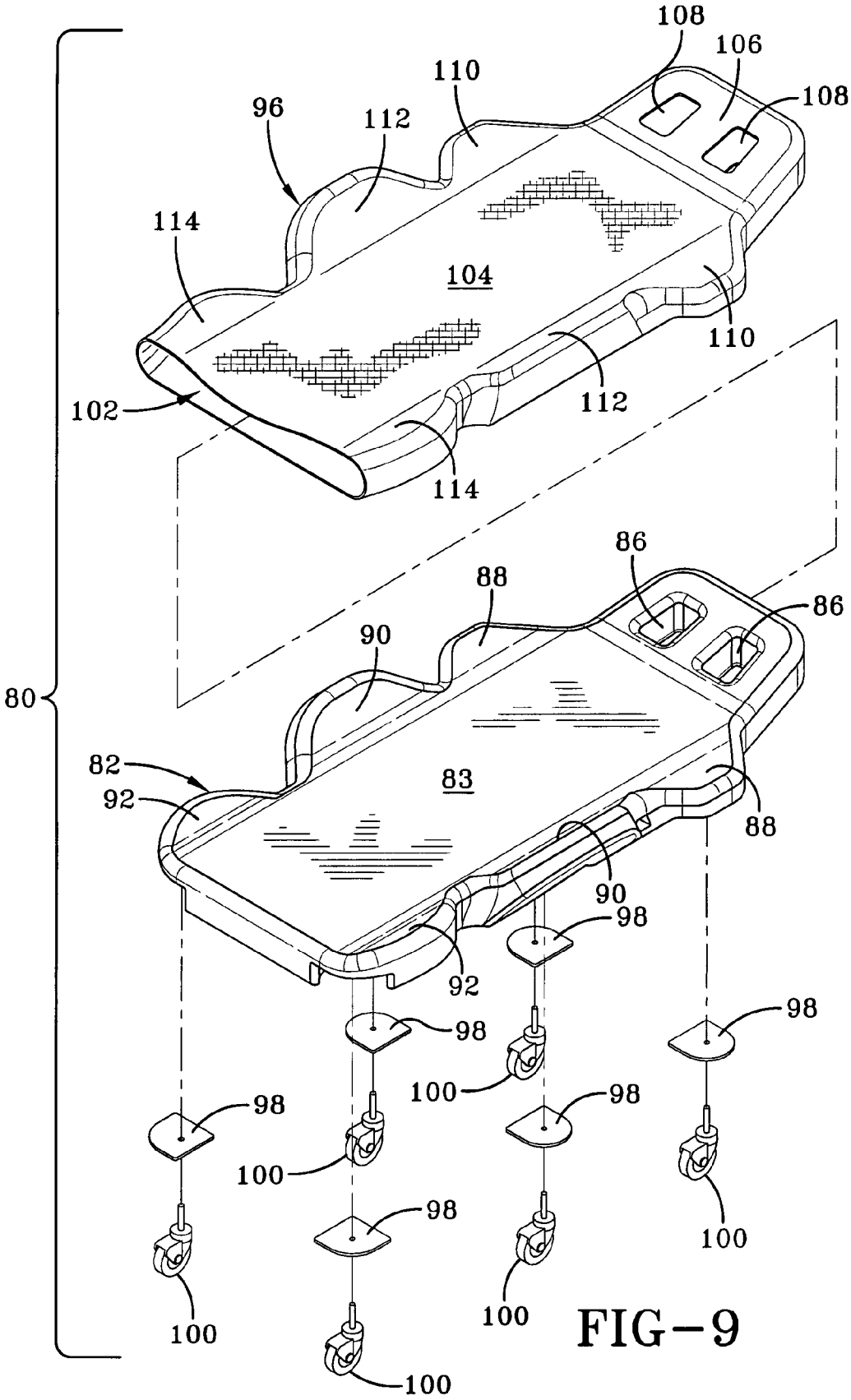
FIG. 9 is an exploded view of the creeper shown in FIG. 7.

Referring now to FIG. 9, in addition to internal support structure 82, creeper 80 includes a cover 96, a plurality of support plates 98, and a plurality of casters 100. Plates 98 are provided to support and receive casters 100 therein. In one or more embodiments, plates 98 may be integrally molded into support structure 82. In other embodiments, plates 98 may be coupled to support structure 82 after formation thereof. As discussed above, casters 100 may be any known in the art and may include threaded or non-threaded stems.

Cover 96 at least partially encapsulates support structure 94. Cover 96 may be any durable material and can include canvas, leather, synthetic leather, car seat upholstery, or any other material suitable for a creeper environment. Cover 96 may be of a one-piece design, having an opening 102 at one end, so that support structure may be inserted through the open end 102 of cover 96. In other embodiments, cover 96 may be of a two piece design, such that one cover half is inserted over either end of support structure 94 and then overlap a predetermined amount. In still other embodiments cover 96 may be of a three piece design. In still other embodiments, cover 96 may cover only an upper portion 101 of support structure 94 and wrap around the exterior edges in a manner such that a portion of the bottom (not shown) of creeper 80 is not covered by cover 96. In these or other embodiments, cover 96 may be composed of a resilient material such that cover 96 may be stretched, positioned over support structure 94 and then allowed to contract.

In all embodiments, cover 96 is configured like support structure 82. As such, cover 96 includes a body 104*a*, headrest 106 with holes 108, and shoulders 110, 112, and 114 corresponding to support structure shoulders 88, 90, and 92, respectively.

In embodiments where cover 70, 96 encapsulates substantially all of creeper 10, 80, including the bottom portion, it should be appreciated that casters 100 extends through holes in cover 96. These holes may be preformed, or may be created during installation of casters 100.

In light of the foregoing, it should thus be evident that a creeper with trays constructed as described herein accomplishes the objects of the present invention and substantially improves the art.

What is claimed is:

1. A creeper comprising an inner frame having laterally spaced side rails interconnected by one or more cross members extending therebetween, a spanning member secured to said inner frame, a pad carried by said spanning member and said frame, a cover that encompasses said pad and at least a portion of said inner frame therein, a plurality of openings in said cover and a plurality of caster assemblies secured to said inner frame and extending through said openings.

2. The creeper of claim 1 wherein said cover completely encompasses said inner frame.

3. The creeper of claim 1 wherein said inner frame includes at least one pair of opposed inner support members extending outwardly and forming shoulders.

4. The creeper of claim 3 wherein said support members include a single curved member extending from a central position on said side rail to a position proximate a top end of said side rail.

5. The creeper of claim 1 further comprising a plate attached to said side rails at each location of said caster assemblies, each said caster assembly being attached to a said plate.

6. The creeper of claim 1 wherein said inner frame defines an outer periphery, said cover extending over said pad and wrapping around said outer periphery.

7. The creeper of claim 3 wherein said inner frame includes a second pair of opposed inner support members extending outwardly and forming a second pair of shoulders.

8. A creeper comprising an inner frame having laterally spaced side rails interconnected by one or more cross members extending therebetween, a first pair of opposed inner support members extending outwardly and forming a first pair of shoulders, a second pair of opposed inner support members extending outwardly and forming a second pair of shoulders, a spanning member secured to said inner frame, a pad carried by said spanning member, a cover that encompasses said pad and substantially all of said inner frame therein, and a plurality of caster assemblies secured to said inner frame, wherein said second support members include a curved member extending from a central position on said side rail to a position proximate a bottom end of said side rail.

9. The creeper of claim 8 wherein said pad includes a plurality of wings that are positioned over said first and said second support members.

10. A creeper comprising an internal support structure that defines a headrest portion and a body portion adapted to support the weight of a user, said internal support structure including laterally spaced side rails and a pair of curved members extending outwardly from a central position on said side rails to a position proximate said headrest portion to define a pair of shoulders, a cover encompassing substantially all of said internal support structure, and a plurality of caster assemblies carried by said internal support structure.

11. The creeper of claim 10 further comprising a plurality of support plates secured to said body portion, each adapted to receive and support one of said casters.

12. The creeper of claim 10 wherein said internal support structure includes a polymeric material.

13. The creeper of claim 10 wherein said cover completely encompasses said internal support structure.

14. The creeper of claim 10 further comprising a second pair of shoulders extending outwardly and upwardly from a central portion of said longitudinal side of said body.

15. The creeper of claim 14, further comprising a third pair of shoulders extending outwardly and upwardly from a portion of said longitudinal side of said body proximate to a bottom end of said body portion.

16. The creeper of claim 14 wherein said headrest extends outwardly and upwardly from said body portion.

17. The creeper of claim 10 further comprising a hole extending through said headrest portion and adapted to provide a gripping area.

* * * * *